US009982427B2

(12) United States Patent
Grahek et al.

(10) Patent No.: US 9,982,427 B2
(45) Date of Patent: May 29, 2018

(54) CONCRETE DECK INSERT

(71) Applicant: Cooper Technologies Company, Houston, TX (US)

(72) Inventors: Nicholas Robert Grahek, Highland, IL (US); Abbas A. Moiyadi, Reno, NV (US)

(73) Assignee: Cooper Technologies Company, Houston, TX (US)

( * ) Notice: Subject to any disclaimer, the term of this patent is extended or adjusted under 35 U.S.C. 154(b) by 0 days. days.

(21) Appl. No.: 15/257,597

(22) Filed: Sep. 6, 2016

(65) Prior Publication Data

US 2018/0066426 A1 Mar. 8, 2018

(51) Int. Cl.
*E04B 1/41* (2006.01)
*E04B 5/32* (2006.01)

(52) U.S. Cl.
CPC ..... *E04B 1/4157* (2013.01); *E04B 2005/324* (2013.01)

(58) Field of Classification Search
CPC ..... E04B 1/4157; E04B 2005/324
USPC ..... 52/699
See application file for complete search history.

(56) References Cited

U.S. PATENT DOCUMENTS 3,372,523 A * 3/1968 Hall, Jr. ..... E04B 1/4157 52/336
3,391,514 A * 7/1968 Hall, Jr. ..... E04B 1/4107 52/699
3,769,774 A * 11/1973 Barnes ..... E04B 1/4157 248/58
5,428,936 A * 7/1995 Roth ..... E04B 9/18 248/327
5,546,723 A * 8/1996 Jones ..... E04B 1/0007 411/163
5,740,650 A * 4/1998 Seiber ..... A47B 57/425 403/297
6,460,308 B1 * 10/2002 Armstrong ..... E04B 1/4157 52/293.3
7,093,400 B1 8/2006 Thompson et al.
8,201,381 B2 * 6/2012 Heath ..... E04B 1/4157 52/698
9,567,741 B2 * 2/2017 Espinosa ..... E04B 1/4164
2010/0146904 A1 * 6/2010 Heudorfer ..... E04B 1/4107 52/699
2014/0056669 A1 2/2014 Hsu
2016/0069066 A1 * 3/2016 Connell ..... F16B 5/0225 52/701

FOREIGN PATENT DOCUMENTS

JP 2007-146942 6/2007
JP 2008-196515 A 8/2008

* cited by examiner

*Primary Examiner* — Charles A Fox
*Assistant Examiner* — James Buckle, Jr.
(74) *Attorney, Agent, or Firm* — Senniger Powers LLP

(57) ABSTRACT

A concrete insert for metal deck formed concrete includes an elongate, generally planar body having opposite upper and lower faces, and opposite first and second longitudinal ends. A rod opening is located between the first and second longitudinal ends and extends through the upper and lower faces of the elongate, generally planar body. A female screw thread extends at least partially about a perimeter of the rod opening and protrudes at least one of above the upper face and below the lower face. The female screw thread is configured to threadably mate with a male thread of a threaded rod.

20 Claims, 7 Drawing Sheets

CONCRETE DECK INSERT

FIELD OF THE DISCLOSURE

The present disclosure generally relates to a concrete deck insert, a method of forming the insert, and a method of making metal deck formed concrete.

BACKGROUND OF THE DISCLOSURE

Metal deck or decking is a structure that may be used as forms for concrete. Metal decking is typically corrugated, including spaced apart, upstanding ribs defining channels therebetween. A slab of concrete is poured on the metal decking, filling the channels and covering the ribs, to form metal deck formed concrete. This finished product may form a ceiling or floor of a building, for example. In the case of a ceiling, hanger rods are typically secured in the metal deck formed concrete. The hanger rods may be pre-positioned on the metal decking (i.e., before pouring the concrete) using an insert. The insert includes a brace or strap that is fastened, such as by screws, to either adjacent ribs and spanning across a corresponding channel or a single rib and extending along the length of the rib. A threaded hanger rod (e.g., a bolt) is threaded into a threaded opening of the strap so that an upper portion of the rod extends above an upper surface of the metal decking and a lower portion of the rod extends below a bottom surface of the metal decking. The insert strap is typically an elongate, flat piece of metal (e.g., a plate) that includes only one threaded opening for receiving a threaded rod. This threaded opening is formed by tapping.

SUMMARY OF THE DISCLOSURE

In one non-limiting aspect, concrete insert for metal deck formed concrete generally comprises an elongate, generally planar body having opposite upper and lower faces, and opposite first and second longitudinal ends. A rod opening is located between the first and second longitudinal ends and extends through the upper and lower faces of the elongate, generally planar body. A female screw thread extends at least partially about a perimeter of the rod opening and protrudes at least one of above the upper face and below the lower face. The female screw thread is configured to threadably mate with a male thread of a threaded rod.

In another non-limiting aspect, a method of making a concrete insert for metal deck formed concrete generally comprises: providing sheet metal; forming an elongate, generally planar body having opposite upper and lower faces, and opposite first and second longitudinal ends; forming a rod opening located between the first and second longitudinal ends and extending through the upper and lower faces; and forming a female screw thread extending at least partially about a perimeter of the rod opening and protruding at least one of above the upper face and below the lower face. The female screw thread is configured to threadably mate with a male thread of a threaded rod.

In yet another non-limiting aspect, a method of making metal deck formed concrete generally comprises: providing corrugated metal decking including spaced apart, upstanding ribs defining channels between adjacent ones of the ribs; fastening a concrete insert to one of the ribs. The concrete insert includes an elongate, generally planar body having opposite upper and lower faces, and opposite first and second longitudinal ends; a rod opening located between the first and second longitudinal ends and extending through the upper and lower faces; a female screw thread extending at least partially about a perimeter of the rod opening and protruding at least one of above the upper face and below the lower face; and a threaded rod threadably mated with the female screw thread and extending through the rod opening.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

Figure 1:
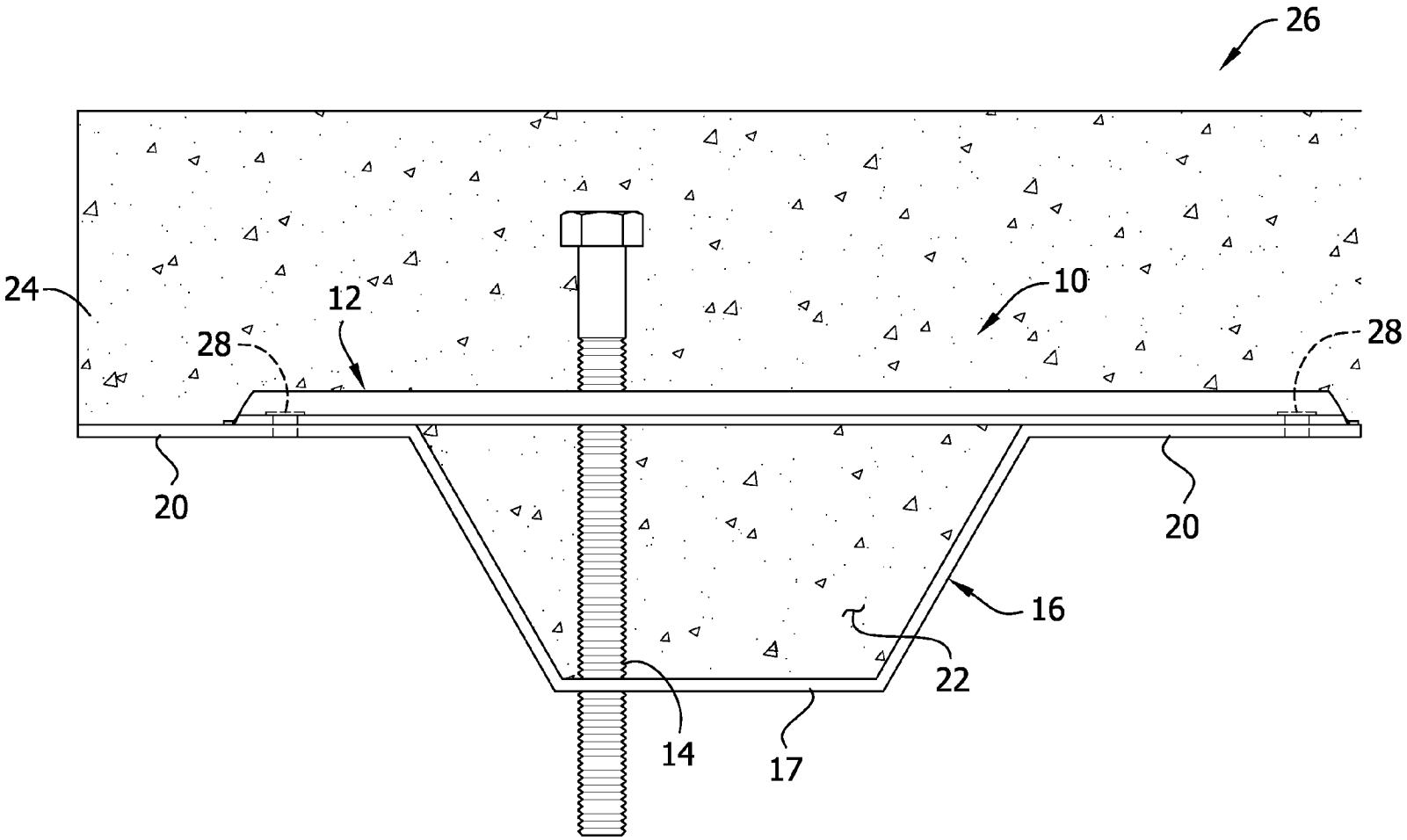
FIG. 1 is a fragmentary schematic of metal deck formed concrete with a concrete insert of one embodiment of the present disclosure in a first orientation relative to the metal deck.
Figure 2:
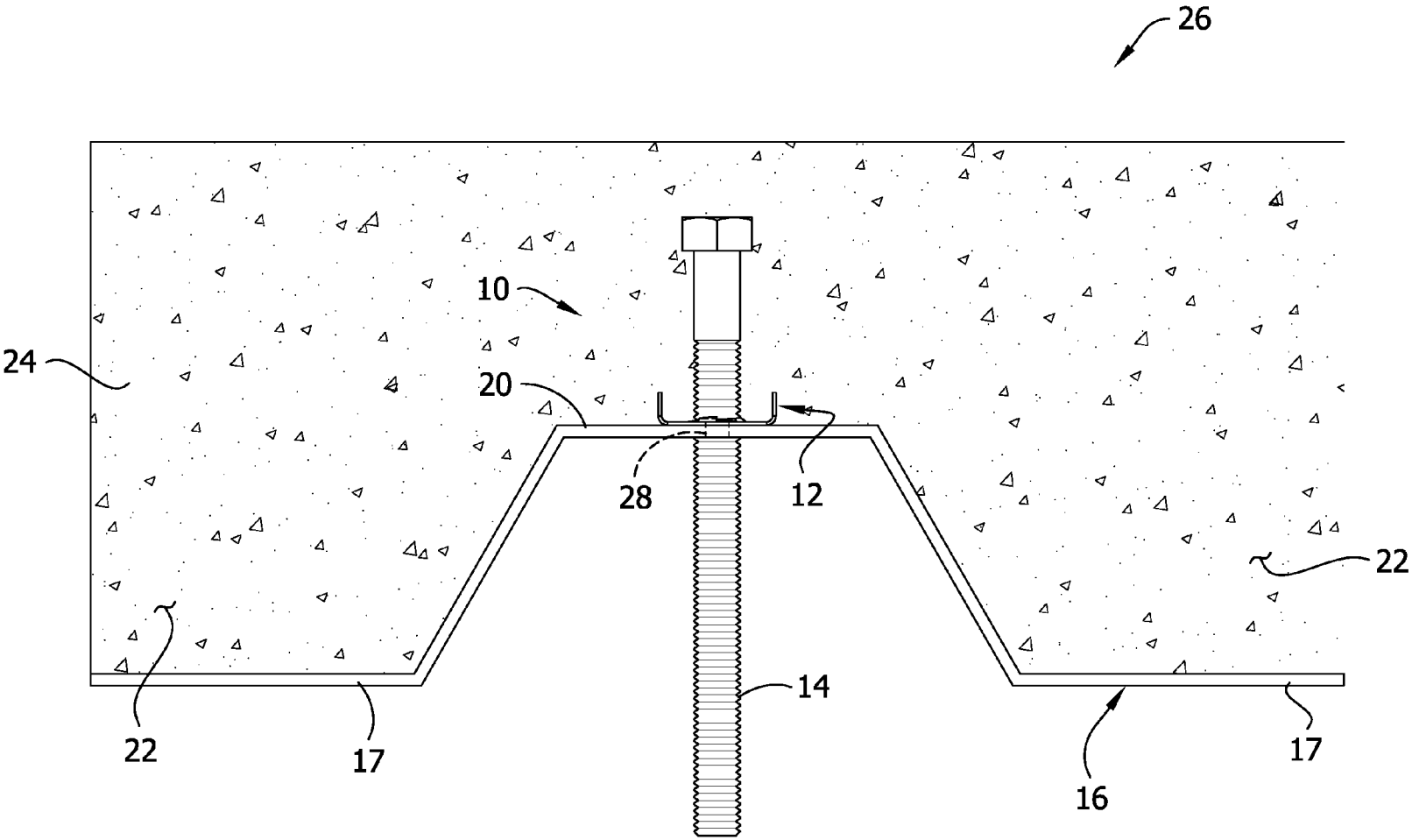
FIG. 2 is similar to FIG. 2 with a concrete insert in a second orientation relative to the metal deck.

Referring to the FIGS. 1 and 2 of the drawings, an illustrated embodiment of a concrete insert is generally indicated at reference numeral 10. The concrete insert 10 generally includes a brace or strap, generally indicated at 12, and a threaded rod (e.g., a bolt or other fastener including a threaded shaft) 14 threadably fastened to the strap. The concrete insert 10 may be used to pre-position the threaded rod 14 on metal decking, generally indicated at 16. The threaded rod 14 extends through an opening in the metal decking 16 such that an upper portion of the threaded rod extends above an upper surface of the metal decking and a lower portion of the threaded rod extends below a bottom surface of the metal decking. The metal decking 16 is corrugated, including spaced apart, upstanding ribs 20 connected by bottom walls 17 to define channels 22 between adjacent ribs. A slab of concrete 24 is poured on the upper side of the metal decking 16, filling the channels 22 and covering the ribs 20 and the concrete insert 10, to form metal deck formed concrete generally indicated at 26. The strap 12 is fastened, such as by screws 28, to either adjacent ribs 20 and spanning across a corresponding channel 22, as shown in FIG. 1 for example, or a single rib and extending along the length of the rib, as shown in FIG. 2 for example. The metal deck formed concrete 26 including the concrete insert 10 may be used to form a ceiling of a building, and the suspended threaded rod 14 can be used to hang mechanical and/or electrical components from the ceiling, as will be generally understood by those having ordinary skill in the art.

Figure 3:
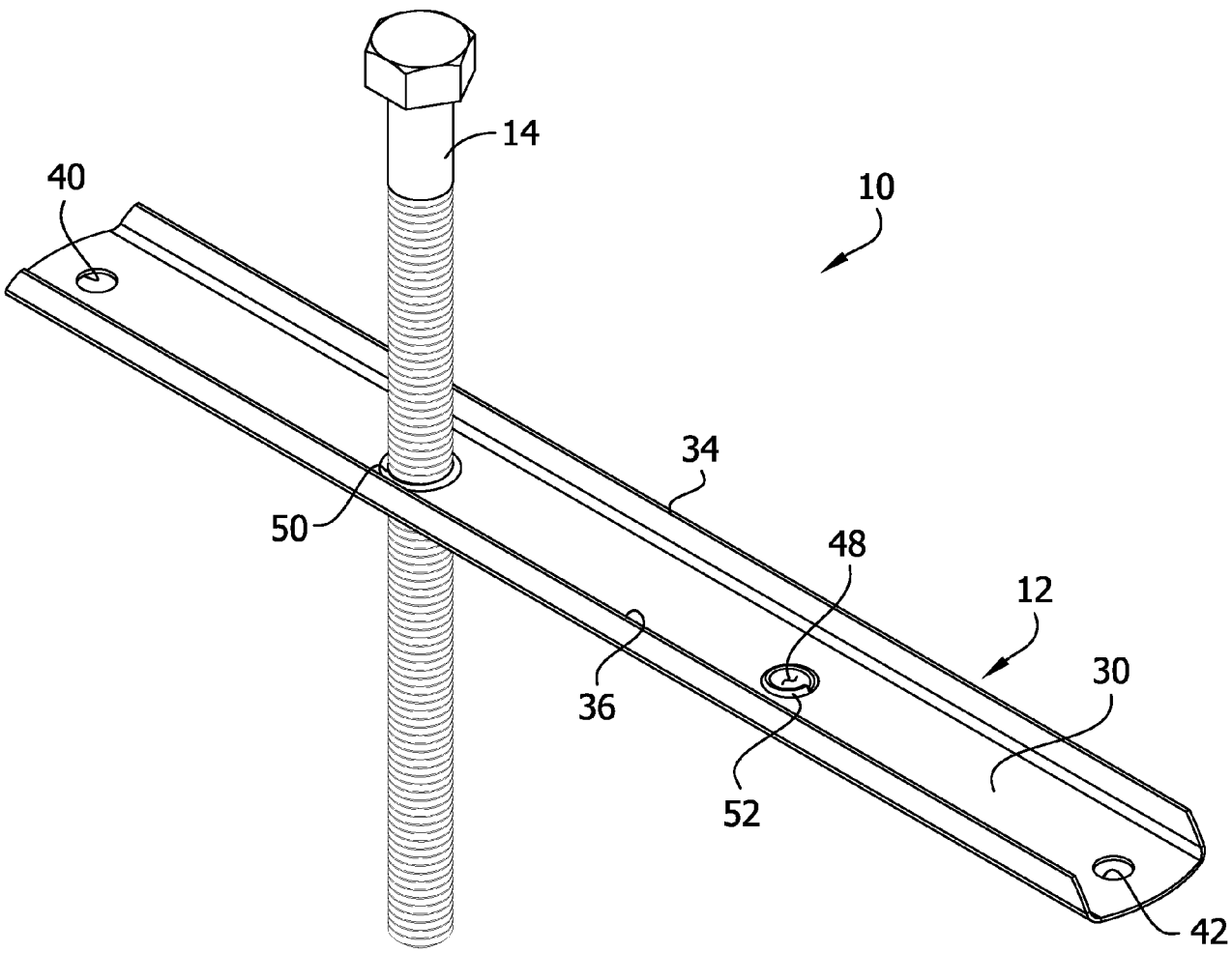
FIG. 3 is a perspective of the concrete insert including a strap and a threaded rod threadably fastened to the strap.
Figure 4:
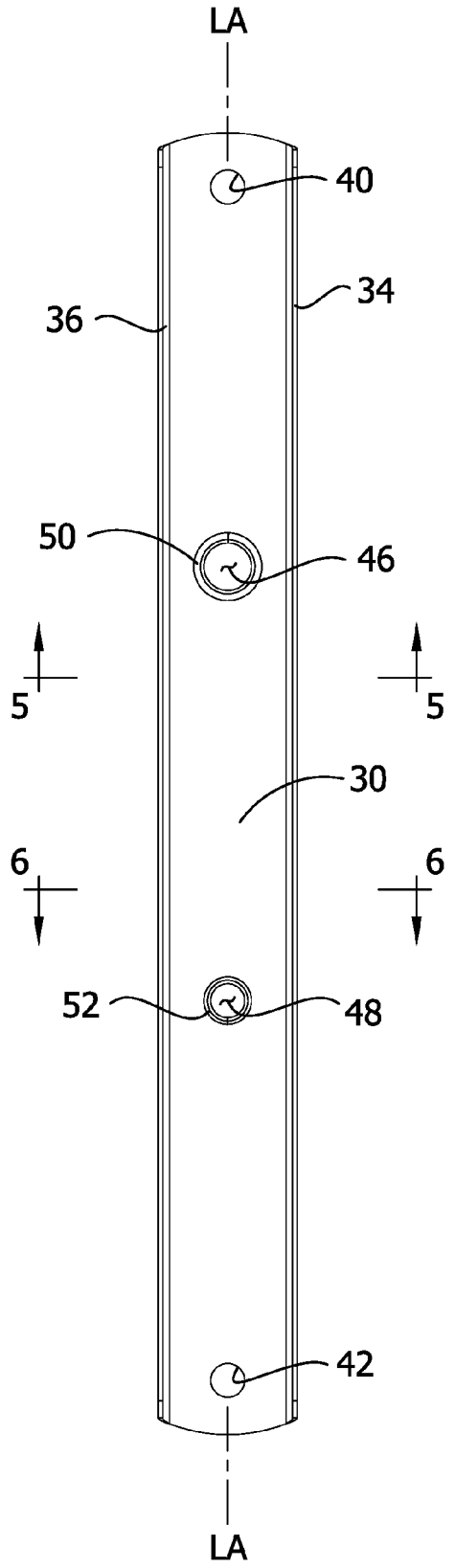
FIG. 4 is a top plan view of strap of the concrete insert.
Figure 5:
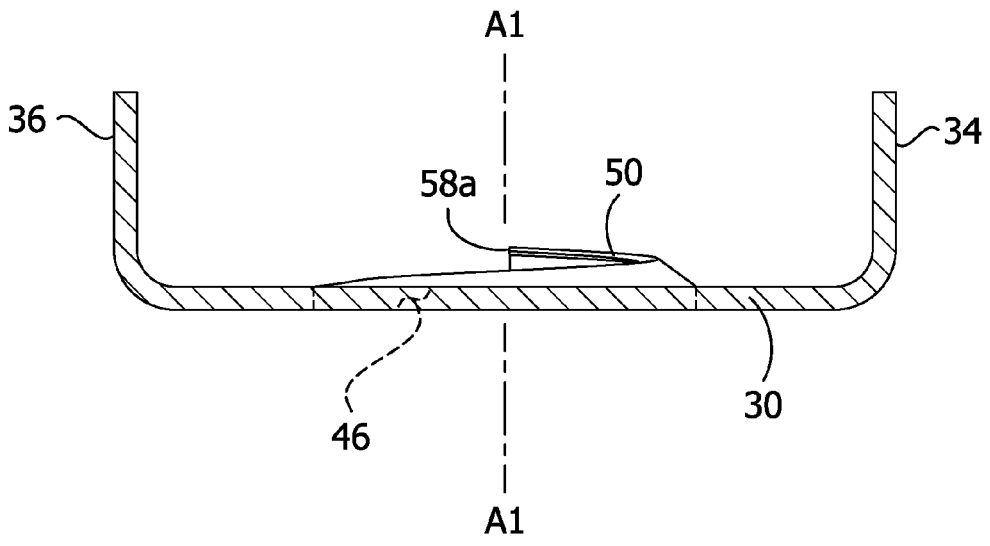
FIG. 5 is an enlarged cross section of the strap taken through the plane defined by line 5-5 in FIG. 4.
Figure 6:
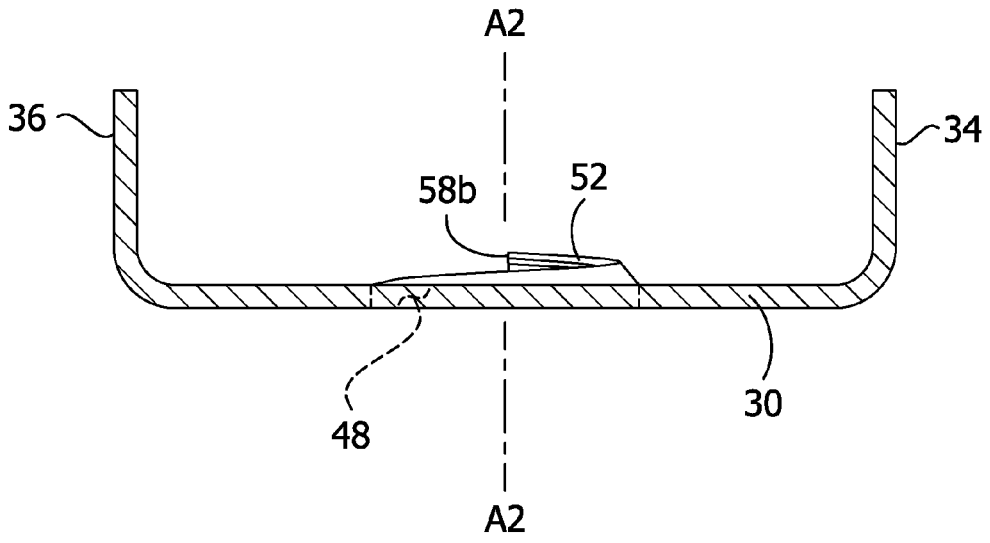
FIG. 6 is an enlarged cross section of the strap taken through the plane defined by line 6-6 in FIG. 4.

Referring to FIGS. 3 and 4, the strap 12 is generally rigid such that it resists bending along its length. The strap 12 includes an elongate, generally planar body 30 having opposite upper and lower faces, and opposite first and second longitudinal ends. A longitudinal axis LA (FIG. 4) extends between the opposite first and second longitudinal ends. A first flange 34 protrudes above a first side of the elongate, generally planar body 30, and a second flange 36 protrudes below a second side of the elongate, generally planar body. The flanges 34, 36 provide enhanced rigidity to the strap 12. The first and second flanges 34, 36 extend along the length of the elongate, generally planar body 30 and generally oppose one another such that the elongate, generally planar body and the first and second flanges define a channel-shaped structure. The strap 12 may have any suitable length, and in one example, the length of the strap may be 12 in (30.48 cm).

The illustrated strap 12 includes a first fastener opening 40 adjacent the first longitudinal end of the elongate, generally planar body 30 and extending through the opposite upper and lower faces. A second fastener opening 42 is adjacent the second longitudinal end of the elongate, generally planar body and extends through the opposite upper and lower faces. As shown in FIGS. 1 and 2, the first and second fastener openings 40, 42 are configured to receive the fasteners 28 (e.g., threaded fasteners, such as self-tapping sheet metal screws) for fastening the concrete insert 10 to the metal decking 16, such as to one or more of the ribs 20. In one or more other embodiments, the first and second fastener openings 40, 42 may be omitted and/or the strap 12 may be secured to the metal decking 16 in other ways without departing from the scope of the present disclosure.

Figure 7:
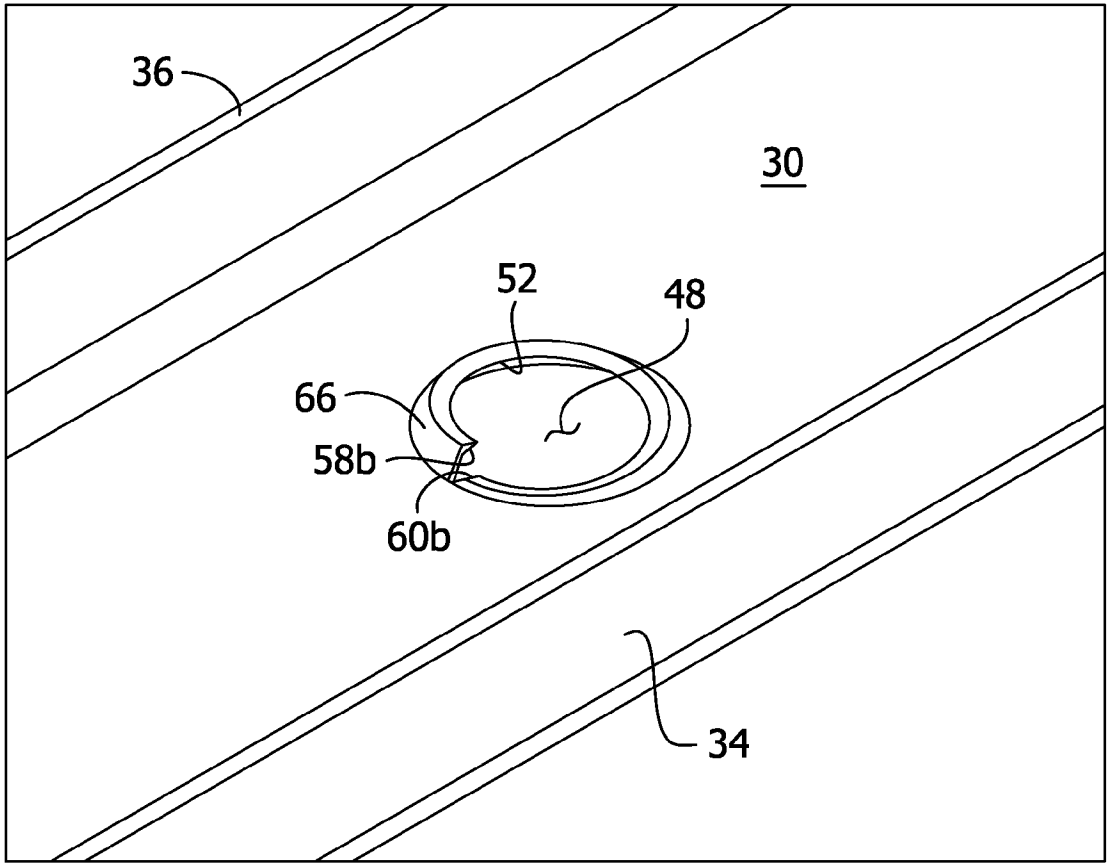
FIG. 7 is an enlarged, fragmentary perspective view of the strap illustrating a first rod opening and a first female thread associated with the first rod opening.
Figure 8:
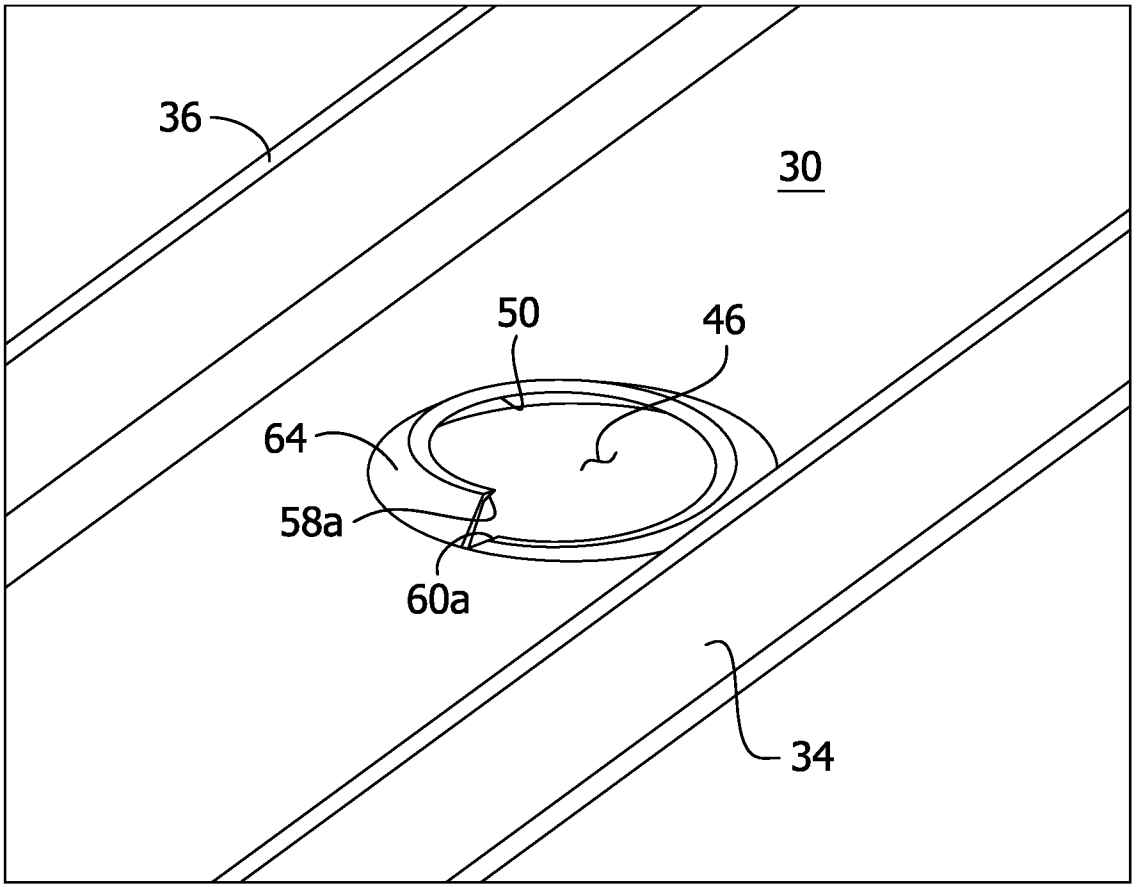
FIG. 8 is an enlarged, fragmentary perspective view of the strap illustrating a second rod opening and a second female thread associated with the second rod opening.

The illustrated strap 12 includes first and second rod openings 46, 48 located between the first and second longitudinal ends and extending through the upper and lower faces of the elongate, generally planar body 30. In one or more other embodiments, the strap 12 may include one and only one of the rod openings 46, 48, or in other embodiments, more than two rod openings. The strap 12 further includes first and second female screw threads 50, 52. The first female screw threads 50 extends at least partially about a perimeter of the first rod opening 46 and protrudes above the upper face of the elongate, generally planar body 30. The second female screw threads 52 extends at least partially about a perimeter of the second rod opening 48 and protrudes above the upper face of the elongate, generally planar body 30. As shown best in FIGS. 7 and 8, each of the female screw threads 50, 52 has opposite first and second arc ends 58*a*, 60*a*, 58*b*, 60*b*. In the illustrated embodiment, the respective first arc ends 58*a*, 60*a* are elevated an upper distance above the upper surface of the elongate, generally planar body 30, and the respective second arc ends 58*b*, 60*b* are elevated a lower distance from (e.g., coplanar with) the upper surface of the elongate, generally planar body 30. The female screw threads 50, 52 taper gradually in distance relative to the upper surface of the elongate, generally planar body 30 from the respective first arc ends 58*a*, 60*a* to the second arc ends 58*b*, 60*b* along the respective arc lengths so that the threads have generally helical shapes. Walls 64, 66 (e.g., spiral or helical walls) connect the respective female screw threads 50, 52 to the elongate, generally planar body 30 to protrude the respective threads above the elongate, generally planar body 30, as explained above.

In the illustrated embodiment, each of the female screw threads 50, 52 extend about one revolution (e.g., 360 degrees) around an axis A1, A2 of the corresponding rod opening 46, 48. In one or more embodiments, the female screw thread(s) may extend less than one revolution or more than one revolution around the axis A1, A2 of the corresponding rod opening 46, 48.

In the illustrated embodiment, the female screw thread(s) 50, 52 do not protrude below the lower surface of the elongate, generally planar body 30. In one or more other embodiments, one or more of the female screw threads 50, 52 may protrude below the lower face of the elongate, generally planar body 30 or may protrude both above the upper face of the elongate, generally planar body and below the lower face of the elongate, generally planar body.

The first female screw thread 50 is configured to threadably mate with a male thread of the threaded rod 14. The second female screw thread 52 is configured to threadably mate with a male thread of a second threaded rod (not shown) having a different diameter than the male thread of the illustrated threaded rod 14. In one example, the first female screw thread 50 has a minimum inner diameter of ½ in (1.27 cm) to mate with a threaded rod having a shaft diameter of ½ in (1.27 cm), and the second female screw thread 52 has a minimum inner diameter of ⅜ in (9.53 mm) to mate with a threaded rod having a shaft diameter of ⅜ in (9.53 mm). The female screw threads 50, 52 and/or the threaded rod 14 may have other diameters without departing from the scope of the present disclosure.

In the illustrated embodiment, the first rod opening 46 is located longitudinally between the first fastener opening 40 and the second rod opening 48 along the length of the strap 12. The second rod opening 48 is located longitudinally between the second fastener opening 42 and the first rod opening 46 along the length of the strap 12. In one example, the strap 12 is 12.0 in (30.48 cm), the center of the first rod opening 46 is 4.0 in (10.16 cm) from the first longitudinal end, the center of the second rod opening 48 is 4.0 in (10.16 cm) from the center of the first rod opening 48, and the center of the second rod opening 48 is 4.0 in (10.16 cm) from the second longitudinal end.

The strap 12 satisfies standards UL-203. In one example, the strap 12 may be formed from a single unitary sheet of metal (e.g., pre-galvanized steel). For example, the sheet metal from which the strap 12 is made may have a uniform thickness of about 0.0375 in (0.953 mm). The thickness of the metal is less than a conventional strap because the flanges 34, 36 enhance rigidity of the strap.

In one exemplary method of making the concrete insert 10, the strap 12 is formed by forming the elongate, generally planar body 30, forming the rod opening(s) 46, 48, and forming the female screw thread(s) 50, 52. This step may be performed in a single manufacturing process since the female screw thread(s) 50, 52 are formed, rather than tapped. The first and second flanges 34, 36 may also formed in the same manufacturing process. The threaded rod 14 may be threadably mated with one of the rod openings 46, 48.

In one example of making the metal deck formed concrete 26, the corrugated metal decking 16 is provided. The concrete insert 10 is fastened to at least one of the ribs 20 of the metal decking 16, such as shown in FIGS. 1 and 2. For example, the concrete insert 10 can be fastened to metal decking 16 using fasteners 28 inserted through the fastener openings 40, 42 and into the rib(s) 20. The threaded rod 14 extends through an opening (not shown) in a bottom of the metal decking partially defining the channel 22 so that the upper portion of the threaded rod 14 extends above the upper surface of the metal decking 16 and the lower portion of the threaded rod extends below the bottom surface of the metal decking. Concrete is poured over the corrugated metal decking 16 and the concrete insert 10.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A concrete insert for metal deck formed concrete comprising:

an elongate, generally planar body having opposite upper and lower faces, and opposite first and second longitudinal ends;

a rod opening located between the first and second longitudinal ends and extending through the upper and lower faces of the elongate, generally planar body;

a helical wall having first and second arc ends and an arc length extending at least partially about a perimeter of the rod opening, the helical wall protruding a distance that is at least one of above the upper face and below the lower face, wherein the distance tapers toward the planar body from the first arc end to the second arc end; and a female screw thread extending along the arc length of the helical wall and protruding radially inward from the helical wall, wherein the female screw thread is configured to threadably mate with a male thread of a threaded rod.

2. A concrete insert for metal deck formed concrete set forth in claim 1, wherein the helical wall protrudes above the upper face of the elongate, generally planar body.

3. A concrete insert for metal deck formed concrete set forth in claim 1, further comprising:

a first fastener opening adjacent the first longitudinal end of the elongate, generally planar body and extending through the opposite upper and lower faces; and a second fastener opening adjacent the second longitudinal end of the elongate, generally planar body and extending through the opposite upper and lower faces, wherein the rod opening is located between the first and second fastener openings relative to the length of the elongate, generally planar body.

4. A concrete insert for metal deck formed concrete set forth in claim 1, wherein a major diameter of the female screw thread is one of: about ½ in (12.7 mm) and about ⅜ in (9.525 mm).

5. A concrete insert for metal deck formed concrete set forth in claim 1, wherein the rod opening constitutes a first rod opening, the helical wall constitutes a first helical wall, and the female screw thread constitutes a first female screw thread, the concrete insert further comprising:

a second rod opening located between the first and second longitudinal ends and extending through the upper and lower faces;

a second helical wall having first and second arc ends and an arc length extending at least partially about a perimeter of the second rod opening, the second helical wall protruding a second distance that is at least one of above the upper face and below the lower face, wherein the second distance tapers toward the planar body from the first arc end to the second arc end of the second helical wall; and a second female screw thread extending along the arc length of the second helical wall and protruding radially inward from the second helical wall, wherein the second female screw thread is configured to threadably mate with a male thread of a threaded rod.

6. A concrete insert for metal deck formed concrete set forth in claim 5, wherein a major diameter of the first female screw thread is greater than a major diameter of the second female screw thread.

7. A concrete insert for metal deck formed concrete set forth in claim 6, wherein the major diameter of the first female screw thread is about ½ in (12.7 mm), wherein the major diameter of the second female screw thread is about ⅜ in (9.525 mm).

8. A concrete insert for metal deck formed concrete set forth in claim 6, wherein the first and second helical walls protrude above the upper face of the elongate, generally planar body.

9. A concrete insert for metal deck formed concrete set forth in claim 1, further comprising the threaded rod including the male thread, wherein the threaded rod is threadably mated with the female screw thread and extends through the rod opening.

10. A concrete insert for metal deck formed concrete set forth in claim 1, further comprising:

a first flange protruding above a first side of the elongate, generally planar body; and a second flange from a second side of the elongate, generally planar body, wherein the first and second flanges generally oppose one another such that the elongate, generally planar body and the first and second flanges define a channel-shaped structure.

11. A concrete insert for metal deck formed concrete set forth in claim 10, wherein the concrete insert is formed from a single, unitary piece of sheet metal.

12. A concrete insert for metal deck formed concrete set forth in claim 11, wherein the concrete insert has a thickness of about 0.0375 in (0.953 mm).

13. A method of making a concrete insert for metal deck formed concrete, the method comprising:

providing sheet metal;

forming an elongate, generally planar body having opposite upper and lower faces, and opposite first and second longitudinal ends;

forming a rod opening located between the first and second longitudinal ends and extending through the upper and lower faces;

forming a helical wall having first and second arc ends and an arc length extending at least partially about a perimeter of the rod opening, the helical wall protruding a distance that is at least one of above the upper face and below the lower face, wherein the distance tapers toward the planar body from the first arc end to the second arc end; and forming a female screw thread extending along the arc length of the helical wall and protruding radially inward from the helical wall, wherein the female screw thread is configured to threadably mate with a male thread of a threaded rod.

14. A method of making a concrete insert for metal deck formed concrete set forth in claim 13, the method further comprising:

forming a first fastener opening adjacent the first longitudinal end of the elongate, generally planar body and extending through the opposite upper and lower faces; and forming a second fastener opening adjacent the second longitudinal end of the elongate, generally planar body and extending through the opposite upper and lower faces, wherein the rod opening is located between the first and second fastener openings relative to the length of the elongate, generally planar body.

15. A method of making a concrete insert for metal deck formed concrete set forth in claim 13, wherein the rod opening constitutes a first rod opening, the helical wall constitutes a first helical wall, and the female screw thread constitutes a first female screw thread, the method further comprising:

forming a second rod opening located between the first and second longitudinal ends and extending through the upper and lower faces;

forming a second helical wall having first and second arc ends and an arc length extending at least partially about a perimeter of the second rod opening, the second helical wall protruding a second distance that is at least one of above the upper face and below the lower face, wherein the second distance tapers toward the planar body from the first arc end to the second arc end of the second helical wall; and forming a second female screw thread extending along the arc length of the second helical wall and protruding radially inward from the second helical wall, wherein the second female screw thread is configured to threadably mate with a male thread of a threaded rod.

16. A method of making a concrete insert for metal deck formed concrete set forth in claim 13, the method further comprising:

forming a first flange protruding above a first side of the elongate, generally planar body; and forming a second flange from a second side of the elongate, generally planar body, wherein the first and second flanges generally oppose one another such that the elongate, generally planar body and the first and second flanges define a channel-shaped structure.

17. A method of making metal deck formed concrete, the method comprising:

providing corrugated metal decking including spaced apart, upstanding ribs defining channels between adjacent ones of the ribs;

fastening a concrete insert to one of the ribs, wherein the concrete insert includes an elongate, generally planar body having opposite upper and lower faces, and opposite first and second longitudinal ends, a rod opening located between the first and second longitudinal ends and extending through the upper and lower faces, a helical wall having first and second arc ends and an arc length extending at least partially about a perimeter of the rod opening, the helical wall protruding a distance that is at least one of above the upper face and below the lower face, wherein the distance tapers toward the planar body from the first arc end to the second arc end, a female screw thread extending along the arc length of the helical wall and protruding radially inward from the helical wall, and a threaded rod threadably mated with the female screw thread and extending through the rod opening.

18. A method of making metal deck formed concrete set forth in claim 17, wherein said fastening a concrete insert comprises:

fastening the first longitudinal end of the elongate, generally planar body to a first one of the ribs; and fastening the second longitudinal end of the elongate, generally planar body to a second one of the ribs, wherein the second one of the ribs is adjacent the first one of the ribs such that the elongate, generally planar body spans across the channel defined by the first and second ones of the ribs.

19. A method of making metal deck formed concrete set forth in claim 17, wherein said fastening a concrete insert comprises fastening the first and second longitudinal ends of the elongate, generally planar body to a first one of the ribs such that the elongate, generally planar body extends along a length of the first one of the ribs.

20. A method of making metal deck formed concrete set forth in claim 17, further comprising pouring concrete over the corrugated metal decking and the concrete insert after said fastening a concrete insert.

* * * * *